United States Patent [19]

Andrejkovics

[11] Patent Number: 4,633,780

[45] Date of Patent: Jan. 6, 1987

[54] ENHANCED POINT DETONATION BACKUP MECHANISM FOR FUZE

[76] Inventor: Richard S. Andrejkovics, R.R. #2, Box 457, Blairstown, N.J. 07825

[21] Appl. No.: 800,243

[22] Filed: Nov. 21, 1985

[51] Int. Cl.[4] ..... F24C 7/00; F24C 19/00

[52] U.S. Cl. ..... 102/274; 102/266

[58] Field of Search ..... 102/272, 274, 275, 265, 102/266, 268, 256, 229, 222, 223

[56] References Cited

U.S. PATENT DOCUMENTS

| | | | |
|---|---|---|---|
| 1,450,672 | 4/1923 | McEwan | 102/272 |
| 2,425,769 | 8/1947 | Wallace | 102/266 |
| 3,913,483 | 10/1975 | Wolterman | 102/227 X |
| 4,047,484 | 9/1977 | Cole | 102/272 X |

*Primary Examiner*—David H. Brown

*Attorney, Agent, or Firm*—Anthony T. Lane; Harold H. Card, Jr.; Michael C. Sachs

[57] ABSTRACT

A backup mechanism for a fuze includes a plate having a slot therein which is freed up during the arming of the firing pin screw. A weight link having a pair of legs spaced along the slot is mounted for movement in the slot. A trip link is pivotally mounted to the plate and has a first leg for frictional engagement against the side of the first weight link leg. The second leg of the trip link is biased for rotation by a leaf spring. Another leaf spring engages against the second leg of the weight link for urging it in a movement direction along the slot. Friction between the first legs of the trip and weight links and/or the upward pull force of the ribbon hold the weight link in an initial position after fuze arming. When exposed to inertia, and/or the absence of upward ribbon pull force the weight link moves. This causes disengagement between its first leg and the first leg of the trip link. The spring rotates the strip link so that its first leg now pushes the weight link along the slot. The further leaf spring engaged against the second link of the weight link also pushes the weight link along the slot. A pin connected to the weight link is engaged with the weight of a standard fuze to enhance the pushing force on the weight.

9 Claims, 5 Drawing Figures

FIG. 2
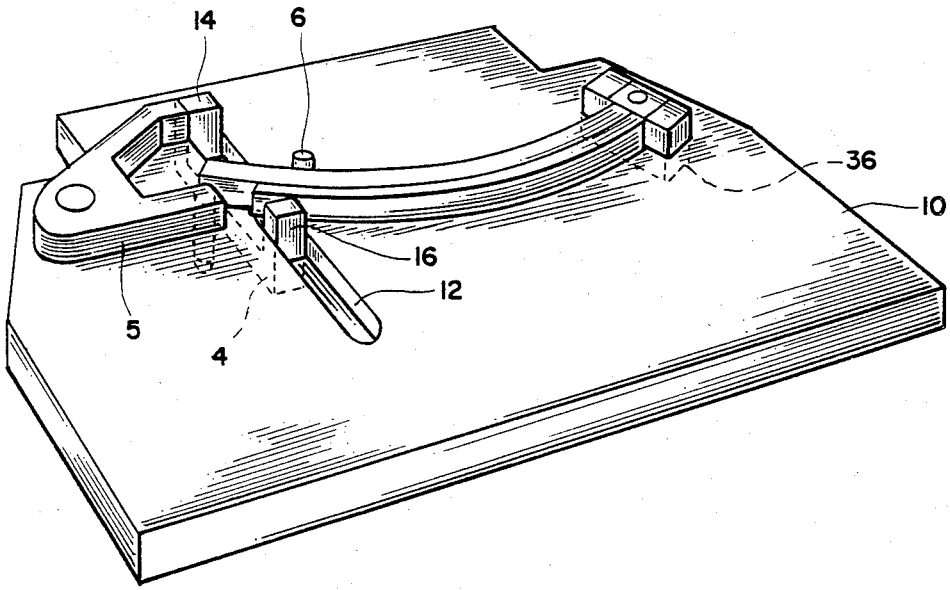
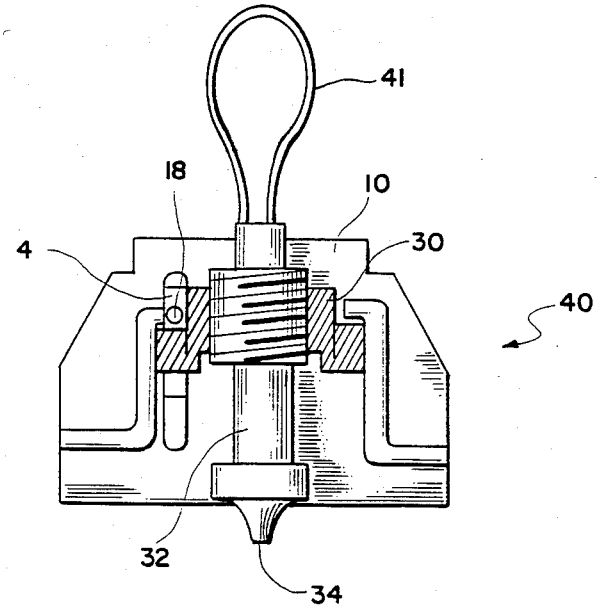
FIG. 5

ENHANCED POINT DETONATION BACKUP MECHANISM FOR FUZE

STATEMENT OF U.S. GOVERNMENT INTEREST

The invention described herein may be manufactured, used and licensed by or for the Government for Governmental purposes without the payment to me of any royalties thereon.

FIELD AND BACKGROUND OF THE INVENTION

The present invention relates in general to the construction of fuzes for explosive devices, and in particular to a new and useful point detonation backup mechanism for a fuze to avoid the hazards of an armed yet undetonated explosive device which has not detonated because of the failure of its fuze.

A fuze is known, in particular a fuze designated the M223 fuze, which is used to detonate various explosive devices including grenades, explosive artillery projectiles, mortar, and rockets. Due in particular to the number of M223 fuzes utilized, the rate of occurrence for armed hazardous duds is quite high. Over 100 million such fuzes per year are projected. Even with a failure rate of only 0.1%, this translates into a yearly potential of 100,000 armed hazardous duds. This poses a significant danger to explosive ordnance personnel and friendly troops during a conflict and to civilians during or after the conflict.

SUMMARY OF THE INVENTION

An object of the present invention is to provide a backup mechanism for fuzes, particularly fuzes for igniting an explosive device, which can actuate the fuze even upon impacts with soft terrain, such as snow, mud or water, hangups in trees, and impacts to the side of explosive devices equipped with the fuze.

The invention is particularly suited for use with the M223 fuze. The invention can readily be attached to an existing fuze without interfering either with the manufacturing process or the normal functioning of the fuze.

The inventive backup mechanism can also survive the high impacts during launch of a rocket or firing of an artillery projectile. The mechanism can be adjusted for impact sensitivity and/or the triggering by the absence of ribbon pull.

Accordingly, a further object of the invention is to provide a point detonation backup mechanism for a fuze which comprises a housing plate, a weight link mounted for movement on a path to said plate, said weight link having a first leg, a trip link pivotally mounted to said plate, said trip link having a first leg for engagement against said first leg of said weight link for frictionally holding said weight link or for ribbon upward pull force to hold said weight in a first position on the path, and biasing means engaged with the trip link for urging the trip link first leg against the weight link first leg, the weight link being movable from its first position along the path to disengage the first legs from each other, the first leg of the trip link being engageable behind the first leg of the weight link with movement of the weight link along the path to further move the weight link along the path by the biasing force of the biasing means.

Another object of the invention is to provide the weight link with first and second legs which are spaced apart along the path, the trip link also having first and second legs, the biasing means comprising at least one leaf spring engaged against the second legs of the weight and trip links.

A still further object of the invention is to provide a point detonation backup mechanism which is simple in design, rugged in construction and economical to manufacture.

The various features of novelty which characterize the invention are pointed out with particularity in the claims annexed to and forming a part of this disclosure. For a better understanding of the inventon, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a perspective view of the mechanism of FIG. 1;

FIG. 5 is a schematic side elevational view showing a fuze which can be used in conjunction with the backup mechanism of the invention.

DESCRIPTION OF THE PREFERRED EMBODIMENT

Figure 1:
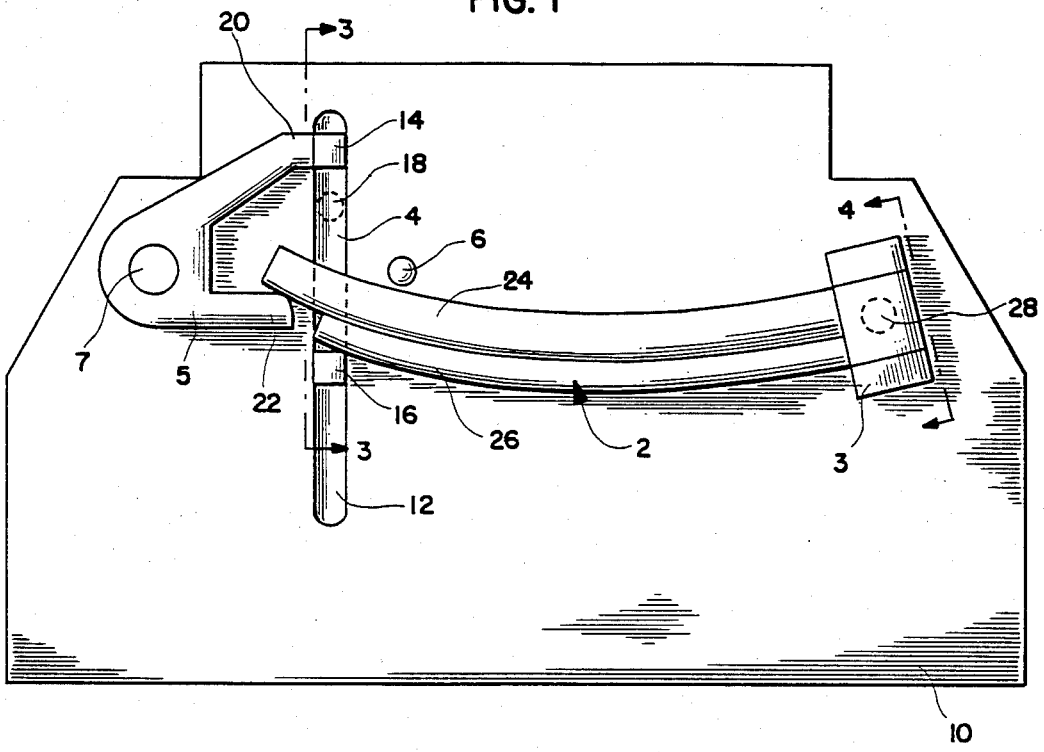
FIG. 1 is a side elevational view of the point detonation backup mechanism in accordance with the invention.
Figure 4:
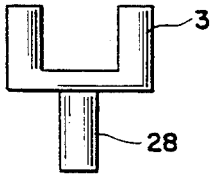
FIG. 4 is a view taken along the line 4—4 of FIG. 1 showing the leaf spring holder of the invention.
Figure 3:
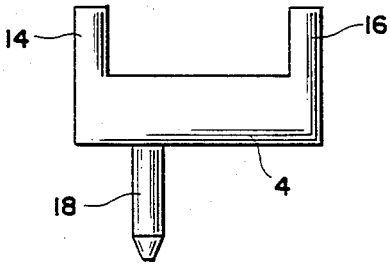
FIG. 3 is a side view taken along line 3—3 of FIG. 1 showing the weight link of the invention.

Referring to the drawings in particular, the invention embodied in FIGS. 1 and 2 comprises an enhanced point detonation backup mechanism having a housing plate 10 with a weight link 4 mounted to the housing 10 for movement along a path. Weight link 4 is mounted in slot 12 which defines the path. FIGS. 1 and 2 show the loaded steady state condition for the backup mechanism with link 4 in its first or initial position in slot 12. As best shown in FIG. 3, link 4 includes first and second legs 14, 16 which are spaced apart in the direction of slot 12. Weight link 4 also includes an engagement pin 18 which is meant for connection to or engagement with a weight 30 of a fuze generally designated 40 in FIG. 5.

A trip link 5 is pivotally mounted on a pin 7 to plate 10. Trip link 5 includes first and second legs 20, 22. First leg 20 is engaged against the side of first leg 14 of weight link 4 in its initial position. Due to a frictional engagement between legs 20 and 14, weight link 4 tends to stay in its initial position. A leaf spring generally designated 2 has a first leaf spring portion 24 which engages against the second leg 22 of trip link 5. The tensioning force of leaf spring 24 can be adjusted or selected to set the amount of pressure exerted by leg 20 against the side of leg 14. A leaf spring is selected by choosing from various different leaf springs of varying thickness, width, length, or material for the one having the desired tension for the particular application, or adjusted by permanently bending the leaf spring somewhat. The tension establishes the amount of force necessary to move weight link 4 away from its initial position to disengage leg 14 from leg 20. The static force between legs 20 and 14 is referred to as the "pull force". the "trip force" is the force which must be applied to weight link 4 to move it downwardly as shown in FIG.

1 away from its initial position. Biasing spring 2 also includes a lower leaf spring 26 which is engaged against the second leg 16 of weight link 4, adding to the "trip force". Both leaf springs 24 and 26 can be made of leaf spring stacks having anywhere from 1 to 9 individual leaf springs that are connected together by gluing or welding for example.

When the tripping force on weight link 4, for example due to an impact on plate 10, exceeds the pull force between legs 20 and 14, with the absence of the ribbon 41 upward trip force or due to a side or soft impact, weight link 4 aided by spring 26 acting on 16 into link 4, moves downwardly disengaging its leg 14 from leg 20 of trip link 5. Spring 24 then acts to pivot trip link 5 in the clockwise direction. Leg 20 of link 5 being behind leg 14 of link 4 then acts to push link 4 downwardly in slot 12. Spring 26 also pushes downwardly on second leg 16 of link 4.

As shown in FIG. 5, this downward force of link 4 is transmitted to weight 30 by pin 18. Weight 30 is connected to a screw type arming pin 32 which carries a firing pin 34 at its lower end. In known fashion firing pin 34 is used to detonate a charge (not shown). Housing plate 10 can actually form a side housing of the fuze 40. The fuze 40 of FIG. 5 may be an M223 fuze of known design. For artillary application, such a fuze uses a ribbon 41 which is pulled to rotate arming pin 32. Arming pin 32 is threaded into weight 30 and its rotation displaces it to move it into an active position where inertia on weight 30 can move pin 32 downwardly so that its firing pin 34 ignites the fuze charge. The backup mechanism of the present invention enhances this downward movement in case there is insufficient impact and/or there is no more upward trip force of the ribbon. The ribbon itself can be mechanically connected to weight link 4 for exerting the trip force which is necessary to initiate the movement of link 4.

Spring 2 including its leaf springs 24 and 26 has a base which is engaged between the arms of a leaf spring holder or support 3. Holder 3 includes a mounting pin 28 which is seated in a hole in plate 10. Plate 10 also includes an elongated rectangular recess 36 which receives the lower rectangular portion of holder 3 above its pin 28. In this way holder 3 is prevented from rotating so that an appropriate amount of tension can be applied to leaf springs 24,26 as they engage the legs 22 and 16.

A set back holding pin 6 is also provided in plate 10 and positioned behind leaf spring 24. Pin 6 is provided to avoid backward movement of leaf springs 24 and 26 when an explosive carrying the backup mechanism is launched. When used in a rocket, pin 6 can be eliminated. Pin 6 is primarily necessary when the inventive backup mechanism is used in an artillary projectile or when the mechanism is to be exposed to high initial accelerations.

Link 5 is also prevented from rotating counterclockwise by the tension of leaf spring 24 on leg 22 of the link.

The amount of pull force necessary to move link 4 can be adjusted by treating the surfaces of legs 20 and 14 which are in frictional engagement with each other. The tension of leaf spring 24 can also be adjusted to a desired level. The downward force that can be exerted by weight link 4 after it is released, can be adjusted by changing the tension of leaf spring 26 as well as the tension of leaf spring 24.

While a specific embodiment of the invention has been shown and described in detail to illustrate the application of the principles of the invention, it will be understood that the invention may be embodied otherwise without departing from such principles.

What is claimed is:

1. A detonation backup mechanism for a fuze, comprising:

a housing plate;

a weight link mounted for movement on a path to the plate, said weight link having a first leg;

a trip link pivotally mounted to said plate, said trip link having a first leg for engagement with said first leg of said weight link for holding said weight link in a first position on the path; and biasing means engaged with said trip link for urging said trip link first leg into said engagement against said weight link first leg by urging said trip link to rotate, and said biasing means also for urging said weight link to move away from its first position on the path, to thereby disengage its first leg from said trip link first leg.

2. A mechanism according to claim 1, wherein said weight link includes a second leg spaced from said weight link first leg along the path, said trip link including a second leg, said biasing means engaged against said second leg of said trip link.

3. A mechanism according to claim 2, wherein said housing plate has a slot therethrough extending along the path, said weight link being slidable in said slot, said trip link being pivotally mounted to said plate near said slot.

4. A mechanism according to claim 3, wherein said biasing means includes a first spring portion engaged against said second leg of said trip link and a second spring portion engaged against said second leg of said weight link, both spring portions being provided for urging said weight link along the path when said weight link is out of its first position.

5. A mechanism according to claim 4, wherein said first and second spring portions both comprise leaf spring stacks.

6. A mechanism according to claim 5, including a set back pin connected to said plate and disposed on a side of said leaf spring stacks for blocking movement of said leaf spring stacks in a direction away from said second legs of said links.

7. A mechanism according to claim 6, wherein said first legs of said links each have a friction contact surface extending parallel to the path.

8. A mechanism according to claim 7, wherein said weight link includes an engagement pin extending in a direction opposite from said first and second legs.

9. A mechanism according to claim 8, wherein said engagement pin and said first and second legs of said weight link all extend in a direction perpendicular to said path.

* * * * *